US006875008B1

(12) United States Patent
Martin et al.

(10) Patent No.: US 6,875,008 B1
(45) Date of Patent: Apr. 5, 2005

(54) LEAN PRE-MIX LOW $NO_X$ BURNER

(75) Inventors: Richard R. Martin, Tulsa, OK (US); Doyle C. Bishop, Tulsa, OK (US); Paul M. Rodden, Beggs, OK (US); Kurt E. Kraus, Tulsa, OK (US)

(73) Assignee: Callidus Technologies, L.L.C., Tulsa, OK (US)

( * ) Notice: Subject to any disclaimer, the term of this patent is extended or adjusted under 35 U.S.C. 154(b) by 176 days.

(21) Appl. No.: 10/353,439

(22) Filed: Jan. 29, 2003

(51) Int. Cl.[7] ..... F23M 3/00; F23L 1/00

(52) U.S. Cl. ..... 431/9; 431/116; 431/181; 431/354

(58) Field of Search ..... 431/354, 115, 431/116, 181, 8, 9, 350, 187, 284, 285, 349; 239/426, 427.3, 431, 433, 434, 424.5

(56) References Cited

U.S. PATENT DOCUMENTS 4,629,413 A * 12/1986 Michelson et al. ..... 431/9
5,073,105 A 12/1991 Martin et al.
5,195,884 A * 3/1993 Schwartz et al. ..... 431/8
5,984,665 A 11/1999 Loftus et al.
6,007,325 A 12/1999 Loftus et al.
6,394,792 B1 * 5/2002 McDonald et al. ..... 431/181
6,565,361 B2 * 5/2003 Jones et al. ..... 438/6
6,695,609 B1 * 2/2004 Chung et al. ..... 431/9
2001/0034001 A1 10/2001 Poe et al.
2002/0015930 A1 2/2002 Poe et al.
2002/0064740 A1 5/2002 Venizelos et al.

* cited by examiner

*Primary Examiner*—James C. Yeung
(74) *Attorney, Agent, or Firm*—McDonnell Boehnen Hulbert & Berghoff LLP

(57) ABSTRACT

An improved burner assembly and process for operating same using a burner design that produces very low levels of undesirable nitrogen oxides is provided. The burner assembly premixes primary fuel and air in a venturi system and recirculates combustion gases back to the burner through a plurality of recirculation conduits where it is mixed with the premix of fuel and air and secondary air prior to combustion in a primary combustion zone. Rapid premixing of the primary fuel and air in the venturi system and the dispersion of the recirculated furnace gases is believed to result in lower peak flame temperatures and therefore minimizing the formation of the pollutants, such as nitrogen oxides.

8 Claims, 1 Drawing Sheet

32
31
33
20
18
1
100
19
7
30
3
6
24
14
25
2
16
8
5
23
11
10
9
12

LEAN PRE-MIX LOW $NO_x$ BURNER

BACKGROUND OF THE INVENTION

1. Field of the Invention

Our invention relates to an environmentally friendly burner assembly and method of using the burner assembly to combust mixtures of fuel and air and fuel, air and recirculated combustion gases. More specifically, our improved burner design uses rapid mixing of primary fuel and air in a venturi system to reduce the combustion temperature and minimize flame volume. Our burner may also recirculates combustion products to minimize the formation of $NO_x$, which is a precursor for air borne pollutants.

2. The Prior Art

Industrial gas burners are designed to generate heat and produce high combustion temperatures, typically in the range of from 2500 to 3000° F. At such temperatures, thermal nitrogen oxides ($NO_x$) can form as gaseous byproducts of the combustion of air and the gas used as the fuel in the burners. These $NO_x$ byproducts are a major source of air pollution and governmental authorities have instituted strict environmental regulations limiting the amount of $NO_x$ gases that can be emitted into the atmosphere. The art has recognized that reducing the peak flame temperature of industrial burners can minimize $NO_x$ formation. Increasing the air/fuel ratio reduces the peak flame temperature. Also, as taught in U.S. Pat. No. 5,073,105, lower flame temperatures may be achieved by recirculating a small portion of exhaust gases (also known as furnace or flue gases) into the combustion zone to mix with the fuel and combustion air. Specifically, the recirculated furnace gases are mixed with fuel gas followed by mixing with the combustion air before combustion. In our invention, the primary fuel mixes with the combustion air then the recirculated flue gas mixes with that mixture. The secondary fuel mixes with recirculated flue gas before it mixes with the air from the interior of the tile. U.S. Pat. Nos. 6,007,325 and 5,984,665 describe a burner design that-has three flame regions, where the first region is formed using a pre-mix burner tip to combust a lean fuel-air mixture. In U.S. Patent Application Nos. US 2002/0064740; US 200110034001; US 2002/0015930; and US 2002/0064740 a number of venturi type premix designs are disclosed, each with a specific tip design. The venturi tip designs restrict and disrupt the flow of the premix exiting the venturi. In addition to the pre-mix burner tip, these designs also use recirculated furnace gases. Previous burner designs have used staging of the air, staging of the fuel, a combination of air and fuel staging, and internal combustion product recirculation to limit the formation of NOx in the combustion process. All of these methods inhibit the mixing of the fuel and air, which results in larger flame volumes and in some cases poor stability. Other known burner designs use the rapid mixing of the primary fuel and air but suffer the problem of instability and "flashback" of the flame into the primary fuel and air mixer assembly.

Our invention solves all of these problems because it uses rapid mixing of the primary fuel and air in a venturi system to minimize the flame volume and eliminates flash back. A side benefit is the reduced size of the burner that permits it to fit existing openings for conventional burners. Our design generates low amounts of $NO_x$ gases, typically in amounts of less than 10 ppmv.

Accordingly, an object of our invention is to provide a burner design and method of using the burner for heating industrial furnaces, boilers, incinerators and other commercial equipment while generating low levels of $NO_x$ emissions.

SUMMARY OF THE INVENTION

As stated, our invention is directed to an improved burner design and method of using the burner to supply heat to industrial equipment through the combustion of air and fuel. Our improved burner combines rapid premixing of primary air and primary fuel within at least one venturi with the injection of secondary fuel to achieve a stable flame and low NOx emissions. The recirculation of combustion product gases may be used to achieve even lower $NO_x$ emissions. Low $NO_x$ levels of 10 ppmv or less greatly reduce the air pollutants that are normally associated with conventional industrial burners. The venturi system used in our burner is designed without the use of special tips or nozzles that typically disrupt and/or restrict the flow exiting the venturi leading to reduced primary air capacity and flashback. When the recirculation of combustion products is used, positioning of the outlets of the venturi system within the interior space of the burner tile and downstream of the recirculation conduits draws in the recirculated combustion product gases into the interior space where they are mixed with the premix of primary air and primary fuel. The primary air/fuel ratio is normally greater than the lean or lower flammability limit, which greatly reduces the chances of flashback occurring. Flashback occurs when the flame moves to a position upstream of the desired point of combustion, which in our design is the down stream or upper edge of the tile, into the interior space of the tile. In such a situation, the flame will burn at the venturi outlet or in the venturi causing damage to the venturi system. Our design avoids this problem because of the lean mixture of fuel and combustion air and the elimination of the restrictive nozzle.

Combustion in a primary combustion zone is maintained at the upper edge of the tile by the use of secondary fuel supplied by tips located on or near the outside surface of the tile. The secondary fuel is used to increase the ratio of fuel to air to the point that the mixture is within the flammability range of mixtures. Typically, anywhere from 40% to 60% of the total fuel is used as primary fuel. In a preferred design, 45% of the total fuel is used as the primary fuel with the balance used as the secondary fuel. A portion of the secondary fuel is also used to combust the combustion products from the first combustion zone in a second combustion zone located downstream of the first combustion zone. In a preferred design approximately 10 to 30% of the secondary fuel is used in the first combustion zone with the balance being used in the second combustion zone.

Primary air control to the venturi system can be achieved using individual air adjustment for the inlet of each venturi or by the use of a primary air wind box having a single damper control. In a variation of our burner design a secondary air supply system or wind box is used in situations where the primary air supply cannot deliver a sufficient amount of oxygen ($O_2$) for complete combustion of the primary and secondary fuel. The secondary air supply may be independent and segregated from the primary air supply, and is delivered to the interior space of the tile through secondary air openings that preferably discharge the secondary air at or above the outlet of the venturis.

BEST MODE FOR CARRYING OUT THE INVENTION

Figure 1:
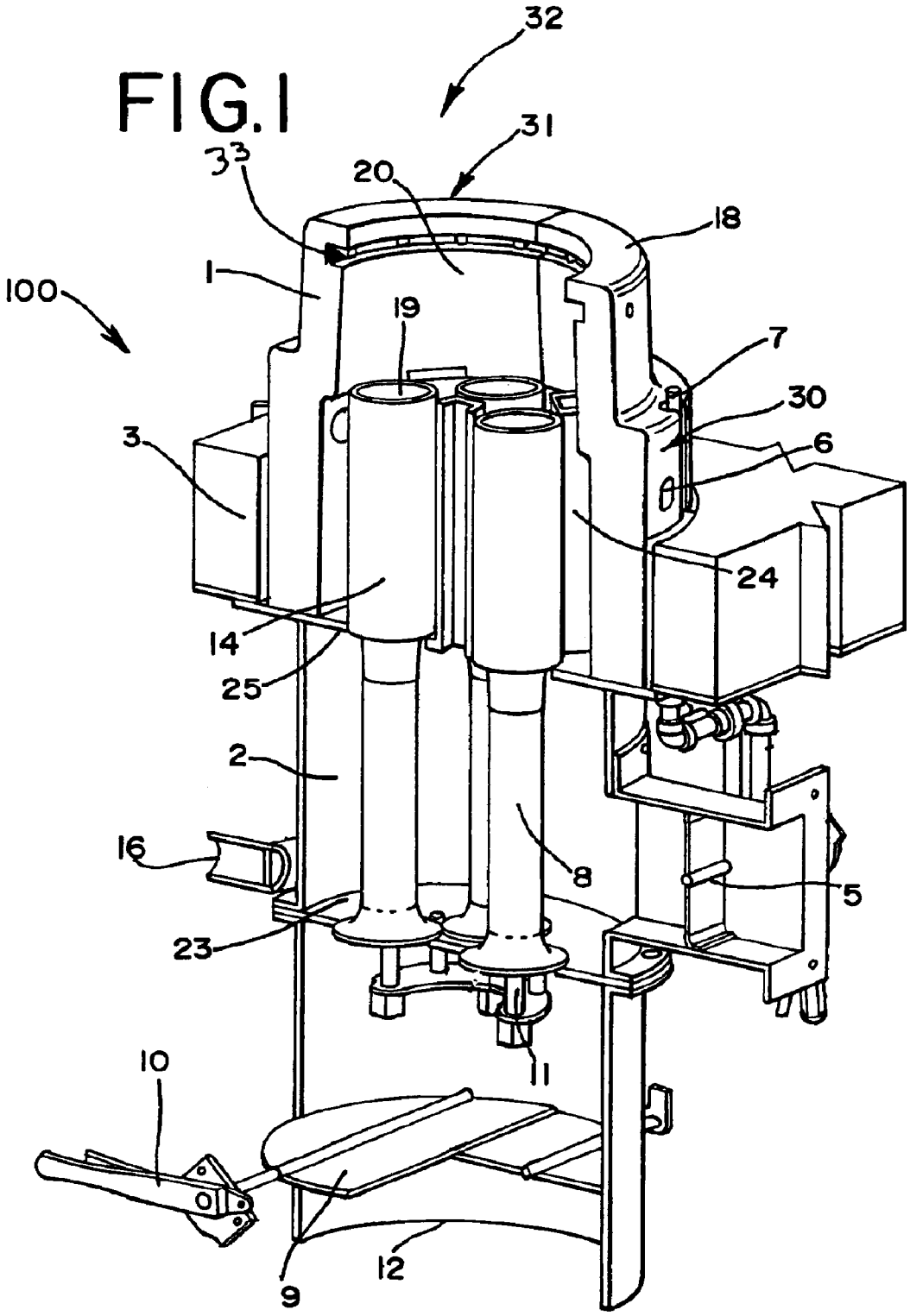
FIG. 1 is a perspective view of one embodiment of the burner assembly of our invention.

While our invention is susceptible of embodiment in many different forms, there is shown in the drawings and will be described below in detail, a specific embodiment with the understanding that the present disclosure is to be considered an exemplification of the principles of the invention and is not intended to limit our invention to the embodiment illustrated.

While the embodiments of the invention discussed below are shown in the environment of a floor of an enclosed structure, such as a furnace, it should be understood that the burners of the present invention may also be installed in a side wall or roof of any structure requiring heating with suitable modification which would be readily apparent to one of ordinary skill in the art having the present disclosure before them, without departing from the principles of the invention. In addition, although the furnaces of the present invention are discussed with respect to natural ("thermal") draft furnaces, it is to be understood that powered burners and/or induced draft burners are also intended to be encompassed by the principles of the invention described herein, with suitable modifications which would be readily apparent to one of ordinary skill in the art having the present disclosure before them.

FIG. 1 illustrates schematically a low NOx burner according to a preferred embodiment of our invention. For clarity purposes, parts of burner 100, including portions of the primary wind box 12 and optional secondary wind box 2 are not shown in FIG. 1 in order to show details of the internal portions of the burner. Burner assembly 100 is mounted or otherwise fixed to an enclosed structure at a furnace wall, roof or floor 3 through mounting plate 25. Burner assembly 100 includes burner tile 1 (also to as a "burner block") which extends outwardly into the heating zone of the enclosed structure and defines an interior space 20. Burner tile 1 also has a plurality of recirculation conduits 6 located around the outside surface of the tile. Recirculation conduits allow combustion product gases produced in the first and second combustion zones 31 and 32 and present within the enclosed structure to be recirculated from the outside surface of the tile 30 into the interior space 20 where it mixes with the premix of primary air, and primary fuel exiting venturi outlet 19 and secondary air if present. We have found that when the amount of furnace gases recirculated through the burner recirculation conduits is increased, the formation of NOx can be reduced to even lower levels of 10 ppmv or less. The increased amount of recirculated furnace gases decreases the concentration of oxygen in the first combustion zone 31 thereby reducing the formation of NOx in the first combustion zone 31. Because the furnace gases are primarily composed of combustion products they are essentially inert and thus do not contribute to the potential for creating hot spots in the flame profile that can ultimately result in the formation of the undesirable nitrogen oxides. In fact, the increased amount of furnace gases has the opposite effect, that of dissipating the temperature profile of the flame, resulting in a cooler flame. This is a result of the inherent heat capacity of the furnace gases, which acts to actually absorb excess heat. A cooler flame will reduce the formation of nitrogen oxides.

A preferred configuration of conduits has an entrance opening on the outside surface of the tile that is greater in dimension than exit opening into the interior space 20, although other geometries can be utilized to reduce flow path area, such as by tapering the top and bottom surfaces. Likewise, while a round shaped conduit is illustrated any shaped conduit can be utilized, including rectangular, oval or square. It is also preferred to have a contoured edge for the entrance openings. In another embodiment, each recirculation conduit is oriented relative to the center axis of burner tile 1 so that the direction of flow of the furnace gases is offset from radial, preferably at angle of at least 30 degrees relative to the axis or centerline of the tile.

Fuel gas to the burner assembly is supplied through manifold 16 and is split between primary fuel tips 11 and secondary fuel tips 7. In FIG. 1, for the sake of clarity, there are no fuel pipes shown connecting the primary fuel tips 11 and manifold 16. As mentioned, the total fuel to the burner is split between the primary and secondary fuel tips. In a preferred configuration 45% of the fuel is supplied to the primary tips and the balance through the secondary tips. Alternatively, the split in the fuel can be manipulated with a suitable control valve or with separate manifolds supplying fuel to each set of tips. Although FIG. 1 shows only one primary tip positioned in or near the inlet of each venturi 8, it is within the scope of our invention, however, to include multiple fuel tips within the inlet of the venturis. The high pressure primary fuel flowing from the primary fuel tips into the inlet of the venturis causes the primary air to be rapidly drawn into the inlet thereby causing rapid mixing of the fuel and air. This forms a "premix" of fuel and air. Below the inlet to the venturis is shown a primary air wind box 12, which receives air for combustion through air damper 9. The damper regulates the amount of combustion air flowing into wind box 12 and this air is induced into the venturis, and ultimately into combustion zone 31. Blowers or other known means can be used to increase the amount of combustion air, if needed. Alternatively, a wind box and damper 9 is not needed if each venturi is provided with its own air control system, which could take the form of individual venturi dampers. In either case, the important consideration is that there must be a means to control the air flow available to the venuris.

The premix flows up the venturi and exits the venturi outlet 19 into the interior space 20. In the embodiment shown in FIG. 1, a venturi covering 14 is shown which extends the venturi outlet 19 above the recirculation conduit openings 6. The venturi covering 14 also allows the venturi to be sealed against mounting plate 25. Having the venturi outlet positioned above the recirculation conduits creates a low pressure region below the venturi outlet which causes the reaction or combustion product gases in the enclosed structures to be drawn or pulled into the interior space 20 through the recirculation conduits 6. The reaction product gases are then mixed with the premix prior to combustion in the first combustion zone 31. The preferred configuration of the venturi outlet is shown as being open-ended, i.e. there is no flow restricting or disrupting tip as is found in prior art burner designs.

In the embodiment shown in FIG. 1, the premix, recirculation gases and secondary air from secondary air conduits 24 are all mixed prior to combustion. Inherently, this mix is of low flammability, which is advantageous because it eliminates the problem of flashback. The flammability of the mixture of gases is increased by the addition of a portion of the secondary fuel that is provided at the upper edge 18 of the tile. This portion of secondary fuel can be supplied by using a single drilled fuel tip 7 or most preferably a double-drilled tip where one drilled hole is angled and positioned to direct a portion of the secondary fuel to the upper edge 18 of the tile. The remainder of the secondary fuel provides the fuel necessary for igniting the combustion products exiting the first combustion zone in the second combustion zone 32 which is located downstream of the first combustion zone 31.

FIG. 1 also shows sealing plate 23, which in conjunction with mounting plate 25 defines the secondary air wind box 2. As mentioned, the use of secondary air in our burner design is not always necessary, but is a useful feature in situations where insufficient primary air is drawn into the venturis. When secondary air is used, secondary air damper 5 controls the secondary air wind box 2. Alternately secondary air can be admitted into the secondary air wind box through openings in sealing plate 23 from the primary wind box or if no primary wind box is used, from the vicinity of the venturi inlets. Air conduits 24 prevent the high velocity premix exiting the venturi from inducing air from the primary or secondary air sources, which increases the efficiency of recirculating the product gases from the enclosed structure back to the burner for complete combustion.

FIG. 1 also shows an optional flame retention device or ring 33. Although not completely understood, it is believed this structure allows more efficient use of a portion of the secondary fuel for combustion in the first combustion zone. It is also possible that the flame retention ring might help stabilize the flame on the upper edge of the tile, especially with the use of fuels with low flame speeds and/or low combustion temperatures.

Although we have shown a preferred embodiment of our burner having a circular shaped title, our improved burner design could likewise be rectangular, oval or square in shape. Use of the improved burner design of the present invention, and the attendant process for heating a furnace which are provided by it, thus results in numerous advantages, many of which are mentioned above. It will be understood that our invention may be embodied in other specific forms without departing from its spirit or central characteristics. The above-mentioned embodiments and figure, therefore, are to be considered in all respects as illustrative and not restrictive, and the invention is not to be limited to the details given here.

We claim:

1. A burner assembly comprising, a) a burner tile having a down stream edge, an outside surface and defining an interior space;

b) at least one venture having an inlet and an outlet, where the outlet is downstream of the inlet and disposed in the interior space of the tile;

c) a primary air control system to control the amount of air entering the inlet of the venture;

d) at least one primary fuel tip disposed in close proximity to the inlet of the venture, where the primary fuel tip supplies fuel to be mixed with the primary air within the venture to form a premix;

e) secondary fuel tips mounted on or near the outside surface of the tile to supply secondary fuel for combustion in a first combustion zone and a second combustion zone;

f) a secondary air chamber defined by a space upstream of the burner tile and downstream of the venture inlet; and g) at least one secondary air opening in fluid communication with the interior space of the tile and with the secondary air chamber, where the secondary air chamber supplies secondary air that mixes with the premix exiting the outlet of the venture and part of the secondary fuel prior to combustion in the first combustion zone.

2. The burner assembly of claim 1 further comprising recirculation conduits located in the tile at a position below the outlet of the venture, where the recirculation conduits provide a passage way between the outside surface of the tile and the interior space of the tile and allow combustion product gases from within the enclosed structure to be recirculated and mixed with the premix and part of the secondary fuel prior to combustion in the first combustion zone located at or above the down stream edge of the tile.

3. The burner assembly of claim 1 further characterized in that the venture outlet is open-ended and does not have a flow restricting tip.

4. The burner assembly of claim 1 wherein the secondary air conduit has a discharge end that is positioned at or down stream of the outlet of the venturi.

5. The burner assembly of claim 1 further comprising a flame retention device located in the proximity of the down stream edge of the tile.

6. A method of operating a burner assembly comprising, in combination, the steps of, a) providing primary fuel and primary air to an inlet of a venturi to cause the primary fuel and primary air to premix before exiting the venture into an interior space within a burner tile, where the burner tile has a down stream edge and an outside surface;

b) providing secondary fuel from at or near the outside surface of the tile to a first combustion zone and to a second combustion zone where combustion product gases from the first combustion zone are combusted; and c) providing secondary air through at least one secondary air opening into the interior space of the burner tile where it mixes with the premix and a portion of secondary fuel before combustion in the first combustion zone, wherein the secondary air and primary air are isolated from each other until mixing in the interior space.

7. The method of claim 6 further comprising recirculating combustion product gases through conduits located below the outlet of the venture and which connect the interior space and outside surface of the tile such that the combustion product gases mix with the premix of primary fuel and primary air in the interior space before being combusted in a first combustion zone located at or near the down stream edge of the tile.

8. The method of claim 6 further comprising introducing the premix from the venture into the interior space without using a flow-restricting tip.

* * * * *